US005845248A

United States Patent [19]

Nishida et al.

[11] Patent Number: 5,845,248

[45] Date of Patent: Dec. 1, 1998

[54] APPARATUS FOR READING OUT TEXTUAL INFORMATION WITH SYNTHESIZED SPEECH, AND TELETEXT RECEIVER

[75] Inventors: Hideharu Nishida, Habikino; Hiroki Ohnishi, Hirakata; Takeshi Yumura, Neyagawa; Masanori Miyatake, Hirakata; Naoyuki Yoden, Toyonaka; Kayo Yoshimura, Ogaki, all of Japan

[73] Assignee: Sanyo Electric Co., Ltd., Osaka, Japan

[21] Appl. No.: 941,232

[22] Filed: Sep. 30, 1997

Related U.S. Application Data

[63] Continuation of Ser. No. 564,803, Nov. 29, 1995, abandoned.

[30] Foreign Application Priority Data

May 25, 1995 [JP] Japan ..... 7-125404
Oct. 31, 1995 [JP] Japan ..... 7-284094

[51] Int. Cl.[6] ..... G10L 5/02

[52] U.S. Cl. ..... 704/260; 704/270; 704/276

[58] Field of Search ..... 395/2.69, 2.79, 395/2.85, 2.86

[56] References Cited

U.S. PATENT DOCUMENTS

| | | | |
|---|---|---|---|
| 4,649,533 | 3/1987 | Chorley et al. | 370/58 |
| 4,700,322 | 10/1987 | Benbassat et al. | 364/513.5 |
| 4,754,326 | 6/1988 | Kram et al. | 364/900 |
| 4,768,144 | 8/1988 | Winter et al. | 364/200 |
| 4,814,972 | 3/1989 | Winter et al. | 364/200 |
| 4,932,024 | 6/1990 | Bonicioli et al. | 370/85.9 |
| 4,935,870 | 6/1990 | Burk, Jr. et al. | 364/200 |
| 5,410,359 | 4/1995 | Odijk et al. | 348/468 |
| 5,565,909 | 10/1996 | Thibadeau | 348/9 |
| 5,583,566 | 12/1996 | Kanno et al. | 348/65 |

*Primary Examiner*—David R. Hudspeth
*Assistant Examiner*—Michael N. Opsasnick
*Attorney, Agent, or Firm*—Armstrong, Westerman, Hattori, McLeland & Naughton

[57] ABSTRACT

An apparatus for reading out textual information with synthesized speech comprises: a buffer memory 24 for buffering character codes of textual information; a keyword/ read-out region storing unit 22 which stores previously specified keyword and region of the textual information, the region being to be read out and including the keyword; a read-out region retrieving unit 23 which retrieves the keyword from the buffered character codes, and which, when the keyword exists, causes character codes corresponding to the read-out region, to be outputted from the buffer memory 24; a speech synthesizing unit 26 which converts the outputted character codes into a synthesized speech signal; and a loudspeaker 14 for outputting the synthesized speech signal in the form of synthesized speech. In textual information of various kinds such as textual information received by a teletext multiplex FM radio, or that of an electronic newspaper, only a portion which relates to a keyword that is previously specified by the user is sounded with synthesized speech, thereby enabling the user to obtain only required information.

8 Claims, 10 Drawing Sheets

FIG. 3

| KEYWORD | READ-OUT REGION |
| --- | --- |
| "OSAKA" | TILL NEXT BLANK INCLUDING KEYWORD |
| [ROUTE 170]OR[OUTER LOOP] | ONE SENTENCE INCLUDING KEYWORD |

APPARATUS FOR READING OUT TEXTUAL INFORMATION WITH SYNTHESIZED SPEECH, AND TELETEXT RECEIVER

This application is a Continuation of application Ser. No. 08/564,803 filed Nov. 29, 1995, now abandoned.

BACKGROUND OF THE INVENTION

1. Field of the Invention

The invention relates to an apparatus for reading out textual information with synthesized speech, and more particularly to an apparatus for reading out only information desired by the user from textual information, with synthesized speech. The invention relates also to a teletext receiver which uses the apparatus.

2. Description of The Related Art

Recently, many services of broadcasting textual information are provided, and various teletext receiver for the services are commercially available. As one of such services, practically used is a teletext multiplex broadcasting service in which textual information obtained by representing characters by character codes are transmitted with use of a free frequency band of FM broadcasting. Accordingly, a teletext multiplex FM radio has been commercially available in which, to a conventional FM broadcasting receiver, a character signal processing circuit for converting a signal of a free frequency band of FM broadcasting into a digital signal to generate character codes, a circuit for displaying the character codes generated by the character signal processing circuit, as font data, and a liquid crystal display device for actually displaying the characters are added.

FIG. 1 is a block diagram schematically showing the configuration of a teletext multiplex FM radio which is an example of such a conventional teletext receiver.

In FIG. 1, reference numeral 11 designates an antenna for receiving an FM radio wave transmitted from a broadcasting station. The radio wave received by the antenna 11 is branched by a branching filter 12 into a frequency band of a normal sound signal and that of textual information. The signal of sound signal frequency band is supplied to a usual sound signal processing circuit 13 which is similar to those used conventionally, to be processed therein, and then out putted as a sound through a loudspeaker 14.

On the other hand, the signal of textual information frequency band branched by the branching filter 12 is supplied to a character signal processing circuit 15 to be converted into a digital signal, and then outputted as character codes. A text displaying unit 16 converts the character codes outputted from the character signal processing circuit 15 into font data, and displays the font data as a character string on a display device 17 such as a liquid crystal display panel. The user reads the character string displayed on the display device 17 and obtains textual information.

Such a teletext multiplex FM radio functioning as a teletext receiver is originally an apparatus for enjoying radio broadcasting. It is sufficient for the user to obtain only required textual information from the screen. However, radio broadcasting and textual information are irrelevant to each other, and hence the user cannot read required textual information unless the user always watches the screen. Consequently, a teletext multiplex FM radio is not easy-to-use in the practical view point.

Furthermore, such a situation may produce very hazardous conditions as described below. When the user, or the driver of an automobile intends to obtain weather forecast, road information, and the like, the driver must continue gazing at the display screen. Therefore, it is practically impossible to obtain information such as weather forecast during driving an automobile, from the teletext multiplex FM radio described above.

In addition to such a teletext multiplex FM radio, other services such as a so-called electronic newspaper are also practically used. In this service, a newspaper containing electronic information is provided, or namely articles of a newspaper are transmitted on-line in the form of textual information to a personal computer or a dedicated receiver. In such an electronic newspaper, a large amount of textual information is transmitted, and hence it is cumbersome for the user to select information.

SUMMARY OF THE INVENTION

The invention has been conducted in view of the above mentioned circumstances. It is an object of the invention to provide an apparatus for reading out textual information with synthesized speech which reads out only a portion of textual information of various kinds of textual information such as that received by a teletext multiplex FM radio, or that of an electronic newspaper, the portion relating to a keyword which is previously specified by the user, thereby enabling the user to obtain only required information without gazing a display screen.

It is another object of the invention to provide a teletext receiver which uses such an apparatus for reading out textual information with synthesized speech.

The apparatus for reading out textual information with synthesized speech and the teletext receiver according to the invention comprise: a buffer memory for buffering character codes of textual information; a keyword/read-out region storing unit which stores a previously specified keyword and a region of the textual information, the region being to be read out and including the keyword; a read-out region retrieving unit which retrieves the keyword stored in the keyword/read-out region storing unit, from the character codes buffered in the buffer memory, and which, when the keyword exists, causes character codes corresponding to the read-out region stored in the keyword/read-out region storing unit, to be outputted from the buffer memory; a speech synthesizing unit which converts the character codes outputted from the buffer memory, into a synthesized speech signal; and means for outputting the synthesized speech signal converted by the speech synthesizing unit, in the form of synthesized speech.

The apparatus for reading out textual information with synthesized speech and the teletext receiver according to the invention also comprise a switch which causes character codes stored in a memory to be outputted, and the character codes are outputted from the memory to the speech synthesizing unit only when the switch is operated.

Further, the apparatus for reading out textual information with synthesized speech and the teletext receiver according to the invention comprise: a buffer memory for buffering character codes of textual information; a keyword storing unit which stores previously specified keyword; a read out start position retrieving unit which retrieves the keyword stored in the keyword storing unit from the character codes buffered in the buffer memory, and which, when the keyword exists, causes character codes following a predetermined position before the keyword, to be outputted from the buffer memory; a speech synthesizing unit which converts the character codes outputted from the buffer memory, into a synthesized speech signal; and means for outputting the synthesized speech signal converted by the speech synthesizing unit, in the form of synthesized speech.

Further, the apparatus for reading out textual information with synthesized speech and the teletext receiver according to the invention also comprise a switch which causes character codes stored in a memory to be outputted, and the character codes are outputted from the memory to the speech synthesizing unit only when the switch is operated.

In the apparatus for reading out textual information with synthesized speech and the teletext receiver according to the invention, character codes of textual information are buffered in the buffer memory, and the read-out region retrieving unit retrieves the keyword stored in the keyword/ read-out region storing unit, from the character codes buffered in the buffer memory. When there exists the keyword, character codes corresponding to the read-out region stored in the keyword/read-out region storing unit are outputted from the buffer memory. The outputted character codes are converted into a synthesized speech signal, and then outputted in the form of synthesized speech.

In the apparatus for reading out textual information with synthesized speech and the teletext receiver according to the invent ion, only when the switch is operated, character codes are outputted from the memory, converted into a synthesized speech signal, and then outputted in the form of synthesized speech.

Further, in the apparatus for reading out textual information with synthesized speech and the teletext receiver according to the invention, character codes of textual information are buffered in the buffer memory, and the read-out start position unit retrieves the keyword stored in the keyword storing unit, from the character codes buffered in the buffer memory. When there exists the keyword, character codes following the read out start position are outputted from the buffer memory. The outputted character codes are converted into a synthesized speech signal, and then outputted in the form of synthesized speech.

Further, in the apparatus for reading out textual information with synthesized speech and the teletext receiver according to the invention, only when the switch is operated, character codes are outputted from the memory, converted into a synthesized speech signal, arid then outputted in the form of synthesized speech.

The above and further objects and features of the invention will more fully be apparent from the following detailed description with accompanying drawings.

BRIEF DESCRIPTION OF THE DRAWINGS

FIG. 3 is a schematic diagram showing examples of a keyword and a read-out region which can be set in the apparatus for reading out textual information with synthesized speech and the teletext receiver according to the invention;

DESCRIPTION OF THE PREFERRED EMBODIMENTS

Figure 2:
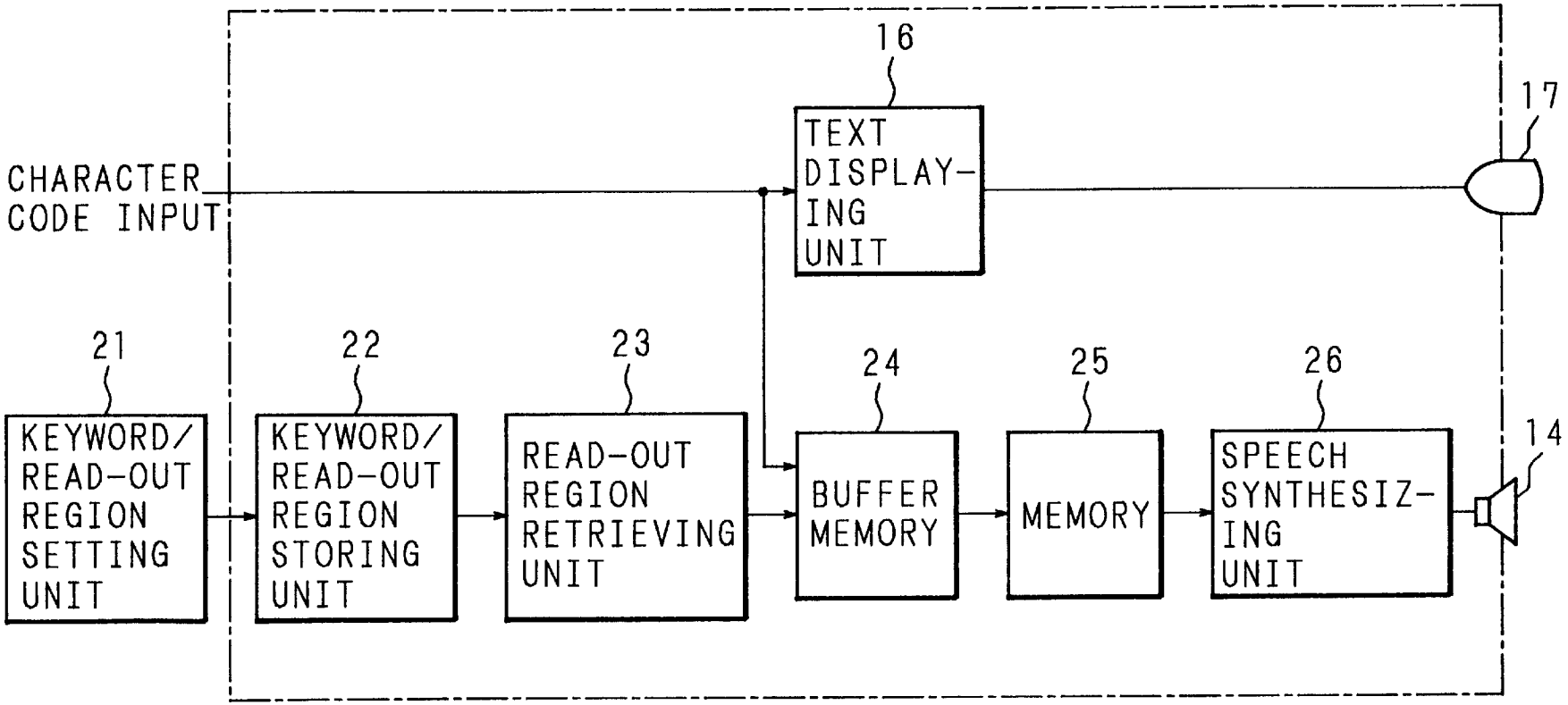
FIG. 2 is a block diagram showing a configuration example of a first embodiment of the apparatus for reading out textual information with synthesized speech according to the invention.

Hereinafter, the invention will be described with reference to the drawings showing its embodiments. FIG. 2 is a block diagram showing a configuration example of a first embodiment of the apparatus for reading out textual information with synthesized speech according to the invention.

In FIG. 2, reference numeral 16 designates a text displaying unit to which character codes are externally inputted. In the text displaying unit 16, the inputted character codes are converted into font data, and the font data are displayed as a character string on a display device 17 such as a liquid crystal display panel. The user reads the character string displayed on the display device 17 and obtains textual information.

The externally inputted character codes are supplied also to a buffer memory 24 in addition to the text displaying unit 16 mentioned above. In the buffer memory 24, a predetermined amount of character codes are buffered in FIFO (First In First Out) basis.

In FIG. 2, reference numeral 21 designates a keyword/ read-out region setting unit. The unit 21 can be realized by, for example, installing a memory card to which desired information is previously inputted with use of a personal computer or the like, or by connecting a touch panel or a miniature keyboard. The user can set a keyword and a read-out region through the keyword/read-out region setting unit 21. In other words, the user can specify desired information by operating the keyword/read-out region setting unit 21 so as to set a keyword and a read-out region. More specifically, as shown in the schematic diagram of FIG. 3, a setting in which the keyword is "OSAKA" and the read-out region is "TILL NEXT BLANK INCLUDING KEYWORD", or another one in which the keyword is "ROUTE 170" or "OUTER LOOP" and the read-out region is "ONE SENTENCE INCLUDING KEYWORD" may be done.

In addition to the examples shown in FIG. 3, for example, the setting of a keyword in the keyword/read-out region setting unit 21 may use the AND logic. The setting may be done without specifying the read-out region. In this case, only the specified keyword is set as the read-out region.

In the case where a memory card is used as the keyword/read-out region setting unit 21, a keyword and a read out region are previously inputted to the memory card by operating a personal computer or the like, and the memory card is then installed into the apparatus. In the case where a touch panel or a miniature keyboard is used as the keyword/read out region setting unit 21, the panel or the keyboard is operated so as to directly set a keyword and a read out region.

The keyword setting may be done by inputting a keyword in the form of a character string, or by previously preparing several keywords and selecting one keyword from several keywords. The read out region setting may be done by specifying the start position and ending position of the read-out region on the basis of the number of characters in the vicinity of the keyword, by automatically detecting one sentence including the keyword on the basis of control codes or the like, or by employing any of other various techniques.

Reference numeral 22 designates a keyword/read-out region storing unit which stores the keyword and the read out region set through the keyword/read-out region setting unit 21.

Reference numeral 23 designates a read-out region retrieving unit. In accordance with the keyword and the read-out region stored in the keyword/read-out region storing unit 22, the read-out region retrieving unit 23 retrieves the keyword from the character string buffered in the buffer memory 24. When the keyword is detected, the read-out region which is preset in accordance with the keyword is retrieved from the character code string buffered in the buffer memory 24, and the retrieved region is stored in a memory 25.

Reference numeral 26 designates a speech synthesizing unit which converts the character code string stored in the memory 25 into a speech signal and then sounds the signal through a loudspeaker 14. In the embodiment, synthesized speech is sounded through the loudspeaker 14. It is a matter of course that an earphone or the like may be used. In summary, any means may be used as far as it can output a synthesized speech signal in the form which can be audibly recognized by a person.

The operation of thus configured first embodiment of the apparatus for reading out textual information with synthesized speech according to the invention will be described.

Character codes externally inputted are sequentially supplied to the text displaying unit 16, and also to the buffer memory 24. The text displaying unit 16 outputs the font data corresponding to the supplied character codes to the display device 17, so that characters are sequentially displayed on the display device 17. Consequently, the user can read the textual information displayed on the display device 17.

Next, the process in which the user presets a keyword and a read-out region through the keyword/read-out region setting unit 21 will be described. As described above, the keyword/read-out region setting unit 21 may be realized by, for example, installing a memory card to which a keyword and a read-out region are previously inputted with use of a personal computer, or by directly connecting a touch panel or a miniature keyboard.

In any case, it is assumed that, the user presets a keyword and a read out region such as those exemplified in FIG. 3 through the keyword/read-out region setting unit 21, the keyword/read-out region storing unit 22 stores the preset keyword and read-out region. The read-out region retrieving unit 23 always retrieves the keyword stored in the keyword/read out region storing unit 22, from the character code string buffered in the buffer memory 24.

It is assumed that textual information as follows is transmitted. ". . . WEATHER FORECAST . . . OSAKA: FAIR (BLANK) KYOTO: FAIR (BLANK) . . . SOUTH OF WAKAYAMA: FAIR AT FIRST, LATER CLOUDY (BLANK) . . . , TRAFFIC INFORMATION . . . IN ROUTE 1, 3-KM CONGESTION AT X INTERSECTION AND DIRECTED TO SOUTH, IN OUTER LOOP, 2-KM CONGESTION AT Y INTERSECTION AND DIRECTED TO NORTH AND 1-KM CONGESTION DIRECTED TO SOUTH, . . . IN ROUTE 2, 1-KM CONGESTION AT XX INTERSECTION AND DIRECTED TO SOUTH AND 2-KM CONGESTION DIRECTED TO NORTH".

When such textual information in the form of a character code string is inputted to the text displaying unit 16, the character code string is converted into font data in a sequential manner by the text displaying unit 16 to be displayed as characters on the display device 17, and at the same time a predetermined amount of the character codes is buffered in the buffer memory 24 in FIFO basis.

In this example, in the keyword/read-out region storing unit 22, "OSAKA", "ROUTE 170", and "OUTER LOOP" are previously stored as keywords, and "TILL NEXT BLANK INCLUDING KEYWORD" and "ONE SENTENCE INCLUDING KEYWORD" are previously stored as read-out regions. Therefore, the read out region retrieving unit 23 always retrieves the keywords "OSAKA", "ROUTE 170", and "OUTER LOOP". When any one of them is detected, the read-out region retrieving unit 23 searches the read-out region corresponding to the detected keyword, and supplies the read-out region to the memory 25.

In this example, the keyword "OSAKA" is detected at first. Then, a character code string corresponding to "TILL NEXT BLANK INCLUDING KEYWORD" which is the read out region corresponding to the keyword is outputted to the memory 25. In other words, the character code string "OSAKA:FAIR" is outputted from the buffer memory 24 to the memory 25 to be stored therein. The character code string is converted by the speech synthesizing unit 26 into a synthesized speech signal and then outputted to the loudspeaker 14. As a result, the loudspeaker 14 sounds synthesized speech "OSAKA FAIR".

Also during the above process, the read-out region retrieving unit 23 retrieves the keywords "OSAKA", "ROUTE 170", and "OUTER LOOP". In this example, the keyword "OUTER LOOP" is detected next. Therefore, a character code string "IN ROUTE 1, 3-KM CONGESTION AT X INTERSECTION AND DIRECTED TO SOUTH, IN OUTER LOOP, 2-KM CONGESTION AT Y INTERSECTION AND DIRECTED TO NORTH AND 1-KM CONGESTION DIRECTED TO SOUTH, . . . IN ROUTE 2, 1-KM CONGESTION AT XX INTERSECTION AND DIRECTED TO SOUTH AND 2-KM CONGESTION DIRECTED TO NORTH" which is a sentence including the keyword "OUTER LOOP" is outputted from the buffer memory 24 to the memory 25 to be stored therein. In the same manner as described above, the character code string is converted by the speech synthesizing unit 26 into a synthesized speech signal and then outputted to the loudspeaker 14. As a result, the loudspeaker 14 sounds synthesized speech "IN ROUTE 1, 3-KM CONGESTION AT X INTERSECTION AND DIRECTED TO SOUTH, IN OUTER LOOP, 2-KM CONGESTION AT Y INTERSEC- TION AND DIRECTED TO NORTH AND 1-KM CONGESTION DIRECTED TO SOUTH, . . . IN ROUTE 2, 1-KM CONGESTION AT XX INTERSECTION AND DIRECTED TO SOUTH AND 2-KM CONGESTION DIRECTED TO NORTH".

As described above, when the user intends to obtain weather forecast of Osaka and road information of Route 170 and Outer Loop, the setting as shown in FIG. 3 is previously done with use of the keyword/read-out region setting unit 21. When textual information inputted from the outside includes a corresponding portion, only the portion is automatically sounded with synthesized speech. Consequently, the user can surely listen desired textual information in the form of synthesized speech, without conducting a cumbersome operation of always paying attention to the display screen.

In the case where only a keyword is specified through the keyword/read-out region setting unit 21, only the keyword is sounded in the form of synthesized speech through the loudspeaker 14. In such a case, when "WEATHER FORECAST" is previously set as a keyword, for example, the loudspeaker 14 sounds speech "WEATHER FORECAST". When such a voice is sounded, the user can see the screen of the display device 17 so as to obtain the textual information following the character string "WEATHER FORECAST" in the form of character display.

Figure 4:
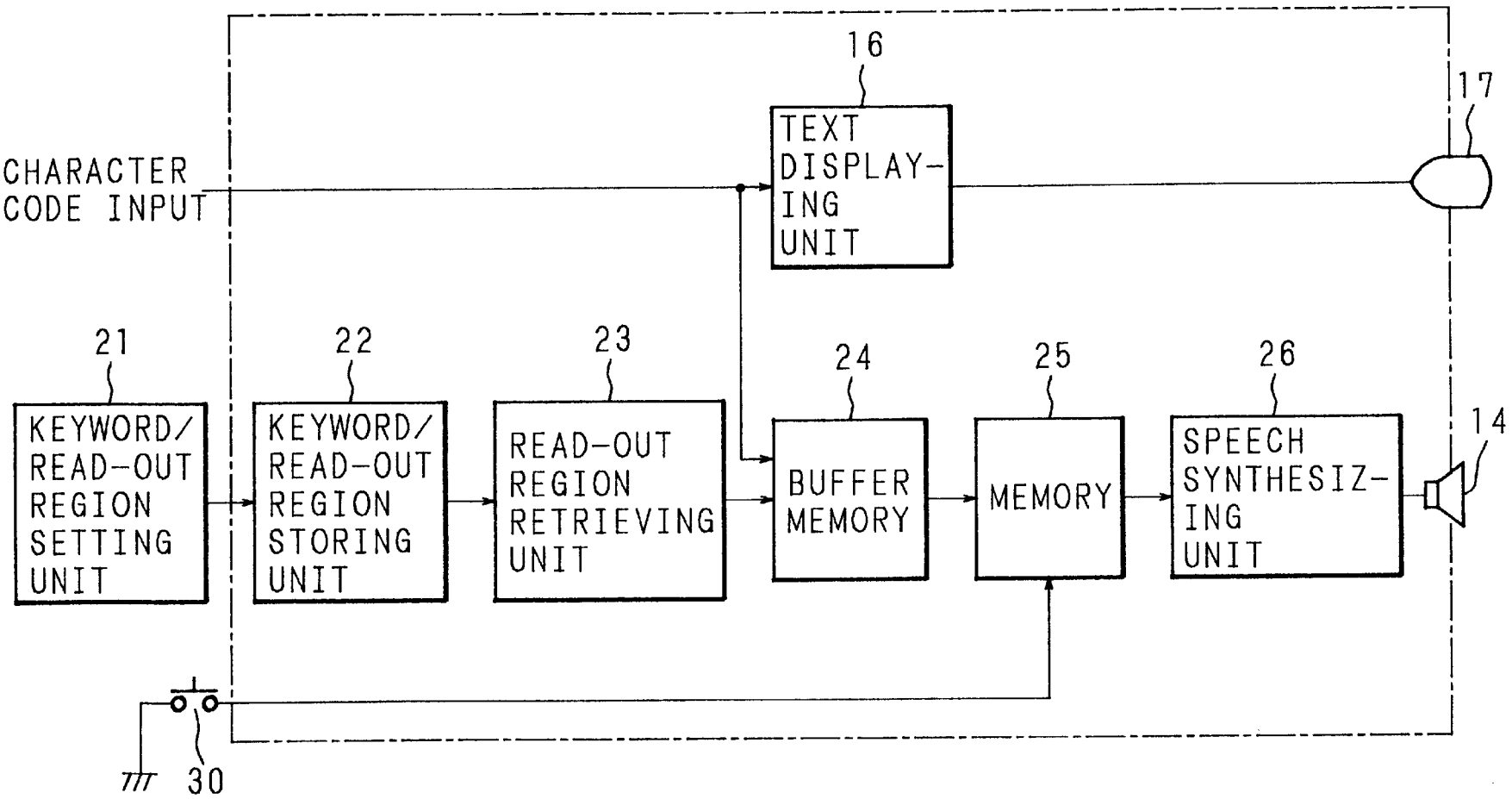
FIG. 4 is a block diagram showing a configuration example of a second embodiment of the apparatus for reading out textual information with synthesized speech according to the invention.

Next, a second embodiment of the apparatus for reading out textual information with synthesized speech according to the invention will be described. FIG. 4 is a block diagram showing a configuration example of the second embodiment.

In the first embodiment shown in FIG. 2, when a preset keyword is detected, the textual information desired by the user is immediately sounded in the form of synthesized speech. However, there may be a case where the user does not wish the apparatus to conduct such an operation. For example, the user may wish to obtain desired information at the time desired by the user. In another case, the voice generated in the form of synthesized speech may be done while the user happens to leave the apparatus, and the user misses listening to the speech.

In view of the above-mentioned circumstances, the second embodiment is configured so that textual information desired by the user is sounded in the form of synthesized speech at the time desired by the user. Specifically, the second embodiment has a configuration in which a manual switch 30 is added to the configuration of the first embodiment shown in FIG. 2. The manual switch 30 is a switch of the so called push button type which is manually operated by the user. When operated, the manual switch 30 supplies a predetermined signal to the memory 25. When the predetermined signal is supplied from the manual switch 30 to the memory 25, the data, i.e., the whole of the character code string stored in the memory 25 is outputted in a sequential manner to the speech synthesizing unit 26.

Thus configured second embodiment operates in the following manner. When the read-out region retrieving unit 23 detects a keyword previously set by the user with use of the keyword/read-out region setting unit 21, the character code string of the read out region which includes the keyword and has been specified by the user is supplied from the buffer memory 24 to the memory 25 to be temporarily stored therein. In this process, the memory 25 conducts only an operation of storing the character code string supplied from the buffer memory 24, and does not perform that of outputting the code string to the speech synthesizing unit 26.

When the user then operates the manual switch 30, the predetermined signal is supplied to the memory 25. At this time, in the case where the memory 25 stores data, that is, the character code string which has been retrieved by the read out region retrieving unit 23 and outputted from the buffer memory 24, the character code string is outputted to the speech synthesizing unit 26. This causes the character code string which has been stored in the memory 25 to be converted by the speech synthesizing unit 26 into a synthesized speech signal and then sounded through the loudspeaker 14.

In the second embodiment, when the user wishes to know weather forecast, the setting for obtaining weather forecast is previously done with use of the keyword/read out region setting unit 21, whereby textual information relating to weather forecast is stored in the memory 25 in the form of character code string. Consequently, the user can listen at a desired time to the information in the form of synthesized speech.

In the second embodiment of the apparatus for reading out textual information with synthesized speech according to the invention, it is a matter of course that a control may be done so as to enable or disable the function of the manual switch 30.

Figure 5:
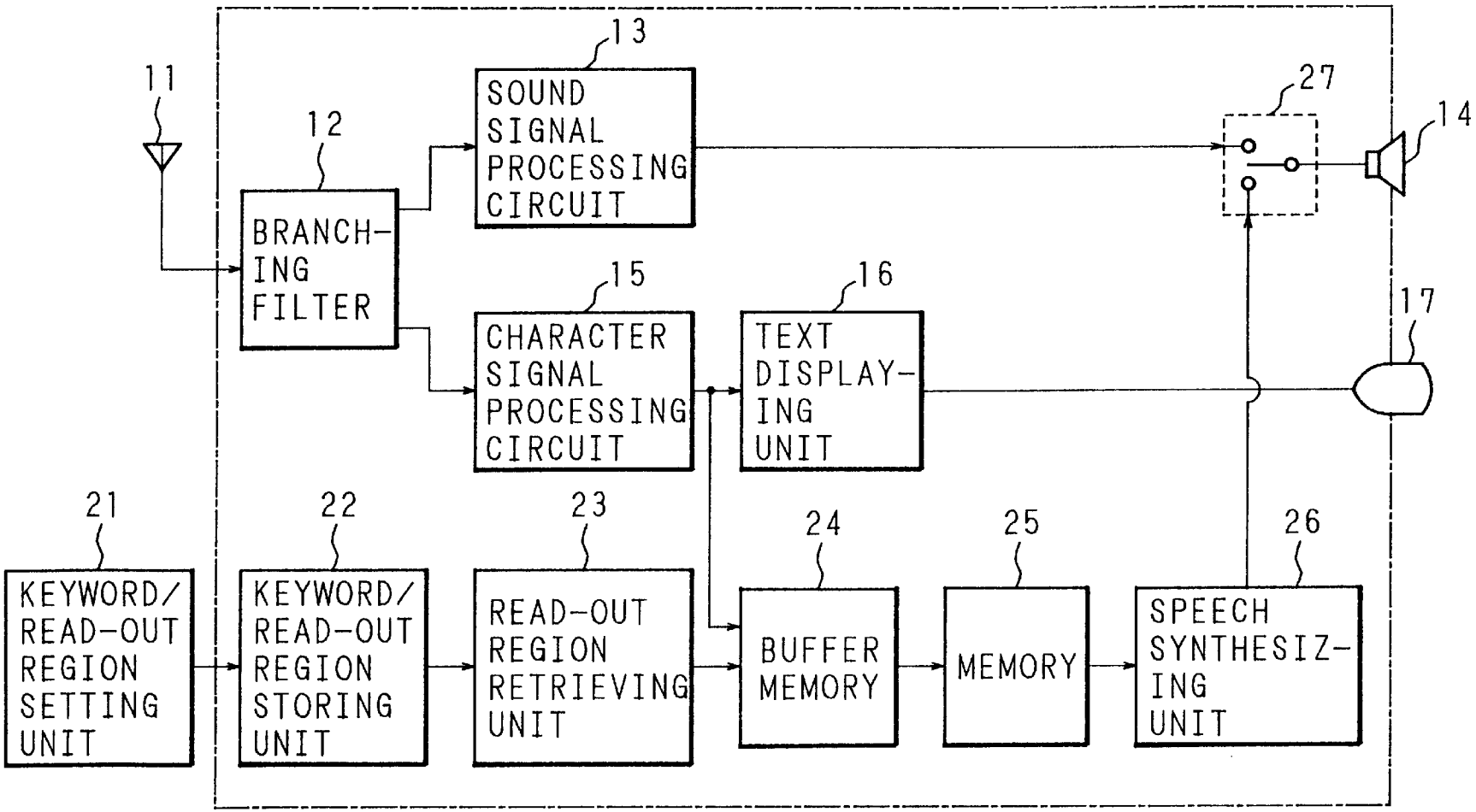
FIG. 5 is a block diagram showing a configuration example of a first embodiment of a teletext multiplex FM radio functioning as a teletext receiver to which the apparatus for reading out textual information with synthesized speech according to the invention is applied.

Next, the case where the apparatus for reading out textual information with synthesized speech according to the invention is applied to a teletext receiver will be described. FIG. 5 is a block diagram showing a configuration example of a first embodiment of a teletext multiplex FM radio functioning as a teletext receiver in which the apparatus for reading out textual information with synthesized speech according to the invention is applied.

In FIG. 5, reference numeral 11 designates an antenna for receiving an FM radio wave transmitted from a broadcasting station. The radio wave received by the antenna 11 is branched by a branching filter 12 into a frequency band of a normal sound signal and that of textual information. The signal of sound signal frequency band is supplied to a usual sound signal processing circuit 13 which is similar to those used conventionally, to be processed therein, and then outputted as a sound through a loudspeaker 14.

On the other hand, the signal of textual information frequency band which has been branched by the branching filter 12 is supplied to a character signal processing circuit 15 to be converted into a digital signal, and then outputted as character codes. A text displaying unit 16 converts the character codes outputted from the character signal processing circuit 15 into font data, and displays the font data as a character string on a display device 17 such as a liquid crystal display panel. The user reads the character string displayed on the display device 17 and obtains textual information.

Figure 1:
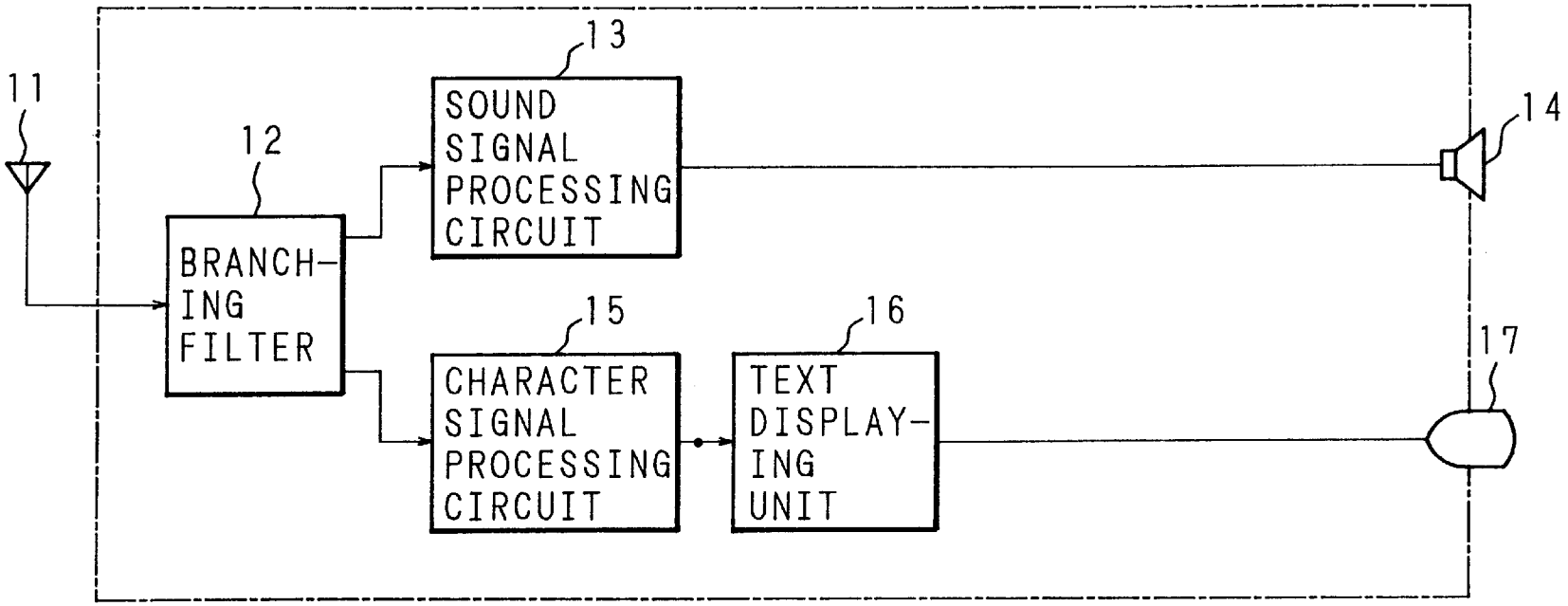
FIG. 1 PRIOR ART
FIG. 1 is a block diagram schematically showing a configuration example of a teletext multiplex FM radio which is a conventional teletext receiver.

The configuration described above is the same as that of the conventional example shown in FIG. 1 except that the switch 27 is disposed. In the embodiment, the character codes outputted from the character signal processing circuit 15 are supplied to the text displaying unit 16 in the same manner as the prior art example, and also to the buffer memory 24. In the buffer memory 24, a predetermined amount of character codes are buffered in FIFO (First In First Out) basis.

In FIG. 5, reference numeral 21 designates a keyword/read-out region setting unit. The keyword/read-out region setting unit 21 can be realized by, for example, installing a memory card to which desired information is previously inputted with use of a personal computer or the like, or by connecting a touch panel or a miniature keyboard. The user can set a keyword and a read-out region through the keyword/read-out region setting unit 21. In other words, the user can specify desired information by operating the keyword/read-out region setting unit 21 so as to set a keyword and a read-out region. More specifically, as shown in FIG. 3 mentioned above, a setting in which the keyword is "OSAKA" and the read-out region is "TILL NEXT BLANK INCLUDING KEYWORD", or another one in which the keyword is "ROUTE 170" or "OUTER LOOP" and the read-out region is "ONE SENTENCE INCLUDING KEYWORD" may be done.

In the same manner as the embodiment described above, in addition to the examples shown in FIG. 3, for example, the setting of a keyword in the keyword/read-out region setting unit 21 may use the AND logic. The setting may be done without specifying the read-out region. In this case, only the specified keyword is set as the read-out region.

In the case where a memory card is used as the keyword/read-out region setting unit 21, a keyword and a read-out region are previously inputted to the memory card by operating a personal computer or the like, and the memory card is then installed into the teletext multiplex FM radio. In the case where a miniature keyboard is used as the keyword/read-out region setting unit 21, the keyboard is operated so as to directly set a keyword and a read out region.

Reference numeral 22 designates a keyword/read-out region storing unit which stores the keyword and the read-out region set through the keyword/read-out region setting unit 21.

Reference numeral 23 designates a read-out region retrieving unit. In accordance with the keyword and the read-out region stored in the keyword/read out region storing unit 22, the read out region retrieving retrieving unit 23 retrieves the keyword from the character string buffered in the buffer memory 24. When the keyword is detected, the read-out region which is preset in accordance with the keyword is retrieved from the character code string buffered in the buffer memory 24, and the retrieved region is stored in a memory 25.

Reference numeral 26 designates a speech synthesizing unit which converts the character code string stored in the memory 25 into a speech signal and then outputs the signal to the switch 27 mentioned above. As described above, also the radio speech outputted from the sound signal processing circuit 13 is supplied to the switch 27 mentioned above. The switch 27 is configured so that, usually, the sound signal processing circuit 13 is connected to the loudspeaker 14, and, only when a synthesized speech is outputted from the speech synthesizing unit 26, the speech synthesizing unit 26 is preferentially connected to the loudspeaker 14.

In the embodiment,through the speech is sounded through the loudspeaker 14. It is a matter of course that a dedicated loudspeaker may be disposed or an earphone or the like may be used. In summary, any means may be used as far as it can output a synthesized speech signal in the form which can be audibly recognized by a person.

The operation of thus configured first embodiment of the teletext multiplex FM radio which is an application example of the apparatus for reading out textual information with synthesized speech according to the invention will be described.

Usually, the teletext multiplex FM radio shown in FIG. 5 operates in the following manner. The antenna 11 receives FM radio wave transmitted from a broadcasting station. The received radio wave is branched by a branching filter 12 into a frequency band of a normal sound signal and that of textual information. The signal of branched sound signal frequency band is supplied to the usual sound signal processing circuit 13 which is similar to those used conventionally, so that a usual speech output of FM broadcasting is done.

On the other hand, the signal of textual information frequency band which has been branched by the branching filter 12 is supplied to the character signal processing circuit 15 to be converted into a digital signal, and then sequentially supplied as character codes to the text displaying unit 16, and also to the buffer memory 24. The text displaying unit 16 outputs font data corresponding to the supplied character codes to the display device 17, with the result that characters are sequentially displayed on the display device 17. The user can read the character string displayed on the display device 17 while listening the sound of the FM broadcasting outputted through the loudspeaker 14.

Next, the process in which the user presets a keyword and a read-out region through the keyword/read-out region setting unit 21 will be described. As described above, the keyword/read-out region setting unit 21 may be realized by, for example, installing a memory card to which a keyword and a read out region are previously inputted with use of a personal computer, or by directly connecting a touch panel or a miniature keyboard.

In any case, when the user presets a keyword and a read out region such as those exemplified in FIG. 3 through the keyword/read-out region setting unit 21, the keyword/ read-out region storing unit 22 stores the preset keyword and read-out region. The read out region retrieving unit 23 always retrieves the keyword stored in the keyword/read-out region storing unit 22 from the character code string buffered in the buffer memory 24.

It is assumed that textual information as follows is transmitted. ". . . WEATHER FORECAST . . . OSAKA: FAIR (BLANK) KYOTO: FAIR (BLANK) . . . SOUTH OF WAKAYAMA: FAIR AT FIRST, LATER CLOUDY (BLANK) . . . , TRAFFIC INFORMATION . . . IN ROUTE 1, 3 KM CONGESTION AT X INTERSECTION AND DIRECTED TO SOUTH, IN OUTER LOOP, 2-KM CONGESTION AT Y INTERSECTION AND DIRECTED TO NORTH AND 1-KM CONGESTION DIRECTED TO SOUTH, . . . IN ROUTE 2, 1- KM CONGESTION AT XX INTERSECTION AND DIRECTED TO SOUTH AND 2-KM CONGESTION DIRECTED TO NORTH".

When such textual information in the form of a character code string is outputted from the character signal processing circuit 15, the character code string is converted into font data in a sequential manner by the text displaying unit 16 to be displayed as characters on the display device 17, and at the same time a predetermined amount of the character codes is buffered in the buffer memory 24 in FIFO basis.

In this example, in the keyword/read-out region storing unit 22, "OSAKA", "ROUTE 170", and "OUTER LOOP" are previously stored as keywords, and "TILL NEXT BLANK INCLUDING KEYWORD" and "ONE SENTENCE INCLUDING KEYWORD" are previously stored as read-out regions. Therefore, the read-out region retrieving unit 23 always retrieves the keywords "OSAKA", "ROUTE 170", and "OUTER LOOP". When any one of them is detected, the read-out region retrieving unit 23 searches the read-out region corresponding to the detected keyword, and supplies the read-out region to the memory 25.

In this example, the keyword "OSAKA" is detected at first. Then, a character code string corresponding to "TILL NEXT BLANK INCLUDING KEYWORD" which is the read-out region corresponding to the keyword is outputted to the memory 25. In other words, the character code string "OSAKA:FAIR" is outputted from the buffer memory 24 to the memory 25 to be stored therein. The character code string is converted by the speech synthesizing unit 26 into a synthesized speech signal and then outputted to the switch 27. In this example, the switch 27 operates so as to connect the loudspeaker 14 with the speech synthesizing unit 26, and hence the loudspeaker 14 sounds synthesized speech "OSAKA FAIR".

When the operation of sounding synthesized speech "OSAKA FAIR" is ended, the switch 27 operates so as to connect the loudspeaker 14 with the sound signal processing circuit 13. Consequently, the loudspeaker 14 again outputs the sound of the FM broadcasting.

Also during the above process, the read out region retrieving unit 23 retrieves the keywords "OSAKA", "ROUTE 170", and "OUTER LOOP". In this example, the keyword "OUTER LOOP" is detected next. Therefore, a character code string "IN ROUTE 1, 3-KM CONGESTION AT X INTERSECTION AND DIRECTED TO SOUTH, IN OUTER LOOP, 2-KM CONGESTION AT Y INTERSECTION AND DIRECTED TO NORTH AND 1-KM CONGESTION DIRECTED TO SOUTH, . . . IN ROUTE 2, 1-KM CONGESTION AT XX INTERSECTION AND DIRECTED TO SOUTH AND 2-KM CONGESTION DIRECTED TO NORTH" which is a sentence including the keyword "OUTER LOOP" is outputted from the buffer memory 24 to the memory 25 to be stored therein. In the same manner as described above, the character code string is converted by the speech synthesizing unit 26 into a synthesized speech signal and then outputted to the switch 27. The switch 27 operates so as to connect the loudspeaker 11 with the speech synthesizing unit 26. As a result, the loudspeaker 14 sounds synthesized speech "IN ROUTE 1, 3-KM CONGESTION AT X INTERSECTION AND DIRECTED TO SOUTH, IN OUTER LOOP, 2-KM CONGESTION AT Y INTERSECTION AND DIRECTED TO NORTH AND 1-KM CONGESTION DIRECTED TO SOUTH, . . . IN ROUTE 2, 1-KM CONGESTION AT XX INTERSECTION AND DIRECTED TO SOUTH AND 2-KM CONGESTION DIRECTED TO NORTH".

Also in this case, when the operation of sounding synthesized speech is ended, the switch 27 operates so as to connect the loudspeaker 14 with the sound signal processing circuit 13. Consequently, the loudspeaker 14 again outputs the speech of the FM broadcasting.

As described above, when the user intends to obtain weather forecast of Osaka, and road information of Route 170 and Outer Loop, the setting as shown in FIG. 3 is previously done with use of the keyword/read-out region setting unit 21. When received textual information includes a corresponding portion, only the portion is automatically sounded with synthesized speech. Consequently, the user can listen to the FM broadcasting, and also to desired textual information in the form of synthesized speech, without paying attention to the display screen.

In the case where only a keyword is specified through t he keyword/read-out region setting unit 21, only the keyword is sounded in the form of synthesized speech through the loudspeaker 14. In such a case, when "WEATHER FORECAST" is previously set as a keyword, for example, the loudspeaker 14 sounds speech "WEATHER FORECAST". When such a voice is generated, the user can see the screen of the display device 17 so as to obtain the textual information following the character string "WEATHER FORECAST" in the form of character display.

Figure 6:
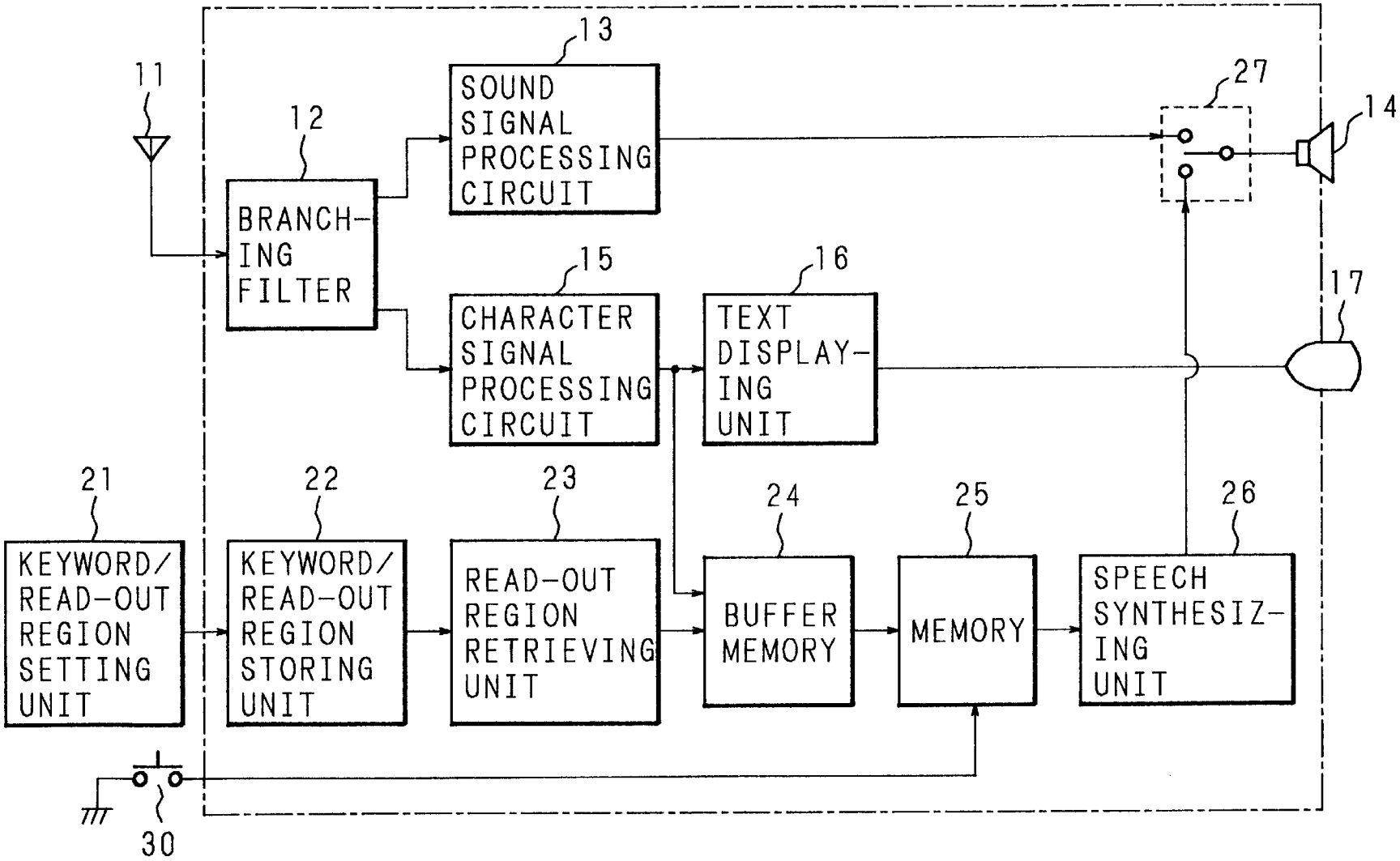
FIG. 6 is a block diagram showing a configuration example of a second embodiment of a teletext multiplex FM radio functioning as a teletext receiver to which the apparatus for reading out textual information with synthesized speech according to the invention is applied.

Next, a second embodiment of the teletext multiplex FM radio which is an application example of the apparatus for reading out textual information with synthesized speech according to the invention will be described. FIG. 6 is a block diagram showing a configuration example of the second embodiment.

In the first embodiment of the teletext multiplex FM radio functioning as a teletext receiver shown in FIG. 5, when a preset keyword is detected, the textual information desired by the user is immediately sounded in the form of synthesized speech. However, there may be a case where the user does not wish the radio to conduct such an operation. For example, the user may wish to obtain desired information at the time desired by the user. In another case, the voice generation in the form of synthesized speech may be done while the user happens to leave the radio, and the user misses listening to the speech.

In view of the above-mentioned circumstances, the second embodiment is configured so that textual information desired by the user is sounded in the form of synthesized speech at the time desired by the user. Specifically, the second embodiment has a configuration in which a manual switch 30 is added to the configuration of the first embodiment shown in FIG. 5. The manual switch 30 is a switch of the so-called push button type which is manually operated by the user. When operated, the manual switch 30 supplies a predetermined signal to the memory 25. When the predetermined signal is supplied from the manual switch 30 to the memory 25, the data, i.e., the whole of the character code string stored in the memory 25 is outputted in a sequential manner to the speech synthesizing unit 26.

Thus configured second embodiment operates in the following manner. In a usual state, the second embodiment operates in the same manner as the first embodiment. When the read out region retrieving unit 23 detects a keyword which is previously set by the user with use of the keyword/read-out region setting unit 21, the character code string of the read-out region which includes the keyword and has been specified by the user is supplied from the buffer memory 24 to the memory 25 to be temporarily stored therein. In this process, the memory 25 conducts only an operation of storing the character code string supplied from the buffer memory 21, and does not perform that of outputting the code string to the speech synthesizing unit 26.

When the user then presses the manual switch 30, the predetermined signal is supplied to the memory 25. At this time, in the case where the memory 25 stores data, that is, the character code string which has been retrieved by the read-out region retrieving unit 23 and outputted from the buffer memory 21, the character code string is outputted to the speech synthesizing unit 26. This causes the character code string which is stored in the memory 25 to be converted by the speech synthesizing unit 26 into a synthesized speech signal and then sounded through the loudspeaker 14.

In the second embodiment, when the user wishes to know weather forecast, the setting for obtaining weather forecast is previously done with use of the keyword/read-out region setting unit 21, whereby textual information relating to weather forecast is stored in the memory 25 in the form of character code string. Consequently, the user can listen at a desired time to the information in the form of synthesized speech.

In the above, embodiments in which the apparatus for reading out textual information with synthesized speech according to the invention is applied to a teletext multiplex FM radio have been described. It is a matter of course that the invention is not restricted to them and may be applied to various apparatuses for displaying textual information such as an electronic newspaper, and electronic mail.

In the second embodiment of the teletext multiplex FM radio, it is a matter of course that a control may be done so as to enable or disable the function of the manual switch 30.

Figure 7:
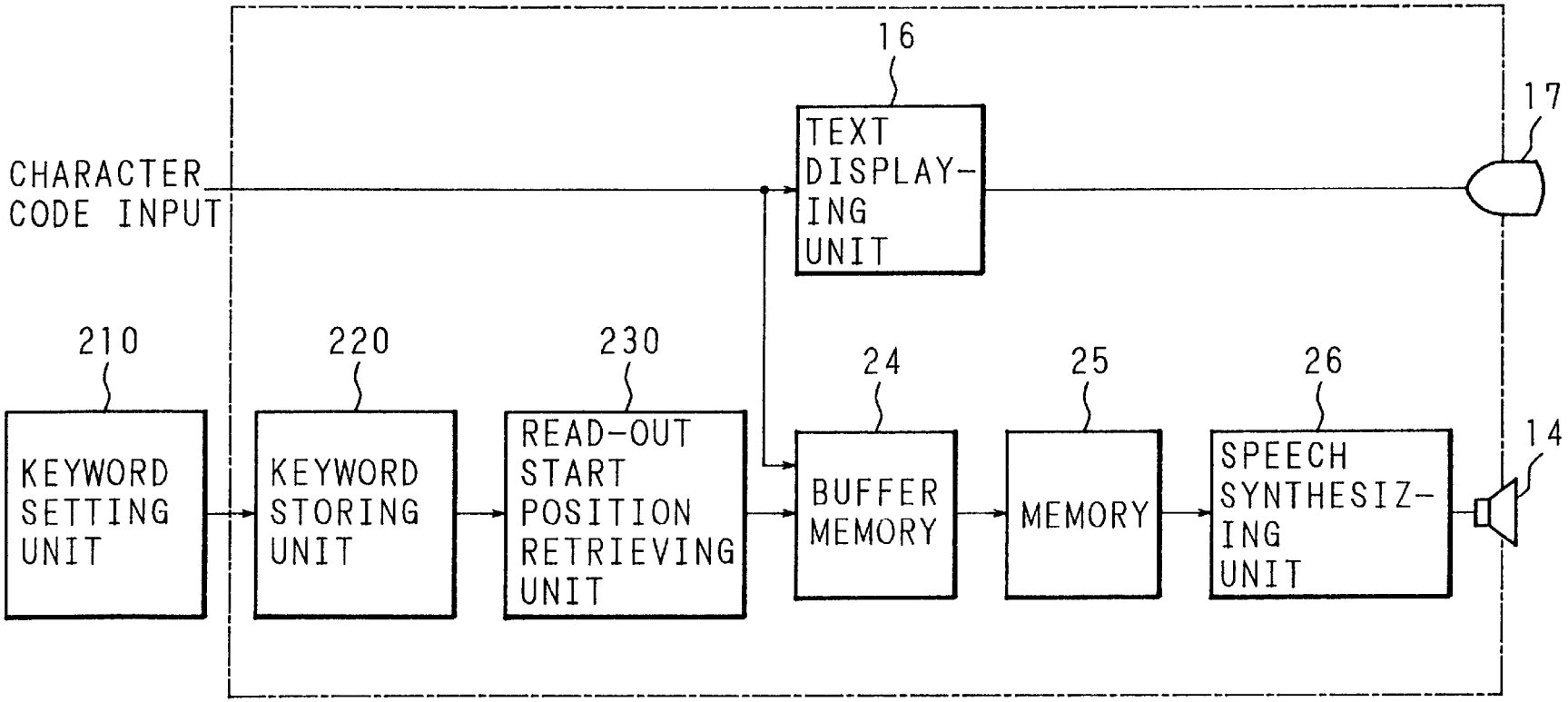
FIG. 7 is a block diagram showing a configuration example of a third embodiment of the apparatus for reading out textual information with synthesized speech according to the invention.

Next, a third embodiment of the apparatus for reading out textual information with synthesized speech according to the invention will be described with reference to a block diagram of FIG. 7 showing a configuration example of the embodiment.

The third embodiment shown in FIG. 7 is different from the above-described first embodiment in the following points. In the third embodiment shown in FIG. 7, the key word/read-out region setting unit 21, the keyword/read-out region storing unit 22, and the read-out region retrieving unit 23 among the components of the fist embodiment shown in FIG. 2 are replaced with a keyword setting unit 210, a keyword storing unit 220, and a read-out start position retrieving unit 230, respectively.

In the above-mentioned first embodiment, the user can set a keyword and a read-out region through the keyword/ read-out region setting unit 21. In the keyword setting unit 210 of the third embodiment, only setting of a keyword is enabled. Specifically, for example, "WEATHER", "ROUTE 170", "OUTER LOOP", etc. may be set independently or in the form of OR conditions.

The keyword/read-out region storing unit 22 of the first embodiment stores a keyword and a read-out region which are set through the keyword/read-out region setting unit 21. The keyword storing unit 220 of the third embodiment stores only a keyword which is set through the keyword setting unit 210.

The read-out region retrieving unit 23 of the first embodiment retrieves the keyword from the character code string buffered in the buffer memory 24 in accordance with the keyword and read-out region stored in the keyword/ read-out region storing unit 22, and, when the keyword is detected, retrieves the read-out region which is preset in accordance with the keyword, from the character code string buffered in the buffer memory 24. The retrieved range is stored in the memory 25. The read-out start position retrieving unit 230 of the third embodiment retrieves the keyword from the character code string buffered in the buffer memory 24 in accordance with the keyword stored in the keyword storing unit 220, and, when the keyword is detected, retrieves a character code string following a preset read-out start position from the character code string buffered in the buffer memory 24. The retrieved character code string is stored in the memory 25.

As the read-out start position which is preset in the read out start position retrieving unit 230, for example, "BLANK IMMEDIATELY BEFORE KEYWORD" or "KEYWORD" may be set.

Functions of other components are as same as those of the first embodiment shown in FIG. 2, and therefore their description is omitted.

The operation of thus configured third embodiment of the apparatus for reading out textual information with synthesized speech according to the invention will be described with respect to the portions which are different from those of the first embodiment.

It is assumed that the user presets keywords "WEATHER", "ROUTE 170", and "OUTER LOOP" in the form of OR conditions through the keyword setting unit 210, and "BLANK IMMEDIATELY BEFORE KEYWORD" as the read-out start position in the read out start position retrieving unit 230. The read-out start position retrieving unit 230 always retrieves the keywords stored in the keyword storing unit 220 from the character code string buffered in the buffer memory 24.

It is further assumed that textual information as follows is transmitted. ". . . TONIGHT'S WEATHER FORECAST . . . OSAKA: FAIR (BLANK) KYOTO: FAIR (BLANK) . . . SOUTH OF WAKAYAMA: FAIR AT FIRST, LATER CLOUDY (BLANK) . . . , TRAFFIC INFORMATION . . . IN ROUTE 1, 3-KM CONGESTION AT X INTERSECTION AND DIRECTED TO SOUTH, IN OUTER LOOP, 2-KM CONGESTION AT Y INTERSECTION AND DIRECTED TO NORTH AND 1-KM CONGESTION DIRECTED TO SOUTH, . . . IN ROUTE 2, 1-KM CONGESTION AT XX INTERSECTION AND DIRECTED TO SOUTH AND 2-KM CONGESTION DIRECTED TO NORTH".

When such textual information in the form of a character code string is inputted to the text displaying unit 16, the character code string is converted into font data in a sequential manner by the text displaying unit 16 to be displayed as characters on the display device 17, and at the same time a predetermined amount of the character codes is buffered in the buffer memory 24 in FIFO basis.

In this example, "WEATHER", "ROUTE 170", and "OUTER LOOP" are previously stored in the keyword storing unit 220 as keywords, and "BLANK IMMEDIATELY BEFORE KEYWORD" is preset as the read-out start position in the read-out start position retrieving unit 230. Therefore, the read-out region retrieving unit 230 always retrieves the keywords "WEATHER", "ROUTE 170", and "OUTER LOOP". When one of the keywords is detected, the read out region retrieving unit 230 then searches the preset read-out start position, and supplies the character code string following the read out start position to the memory 25.

In this example, the keyword "WEATHER" is detected at first. Then, a character code string corresponding to "BLANK IMMEDIATELY BEFORE KEYWORD" which is the preset read-out start position is outputted to the memory 25. In other words, the character code string "TONIGHT'S WEATHER FORECAST . . . OSAKA: FAIR (BLANK) KYOTO: FAIR (BLANK) . . . " is outputted from the buffer memory 24 to the memory 25 to be stored therein. The character code string is converted by the speech synthesizing unit 26 into a synthesized speech signal and then outputted to the loudspeaker 14. As a result, the loudspeaker 14 sounds synthesized speech "TONIGHT'S WEATHER FORECAST . . . OSAKA FAIR KYOTO FAIR . . . ", and the speech generation is continued until the user conducts any further operation.

By contrast, in the case where "KEYWORD" is preset as the read-out start position in the read-out start position retrieving unit 230, a character code string corresponding to the portion following "WEATHER" which is the keyword, i.e., "WEATHER FORECAST . . . OSAKA: FAIR (BLANK) KYOTO: FAIR (BLANK) . . . " is outputted from the buffer memory 24 to the memory 25 to be stored therein, and the loudspeaker 14 sounds synthesized speech "WEATHER FORECAST . . . OSAKA FAIR KYOTO FAIR . . . " This speech generation is continued until the user conducts any further operation.

As described above, in the third embodiment of the apparatus for reading out textual information with synthesized speech according to the invention, the user can preset a keyword with use of the keyword setting unit 210, and, when externally inputted textual information includes a portion corresponding to the keyword, a portion following a predetermined position which exists before the keyword is automatically sounded. When the user wishes to know weather forecast, for example, "WEATHER" is preset as a keyword with use of the keyword setting unit 210. As a result, when externally inputted textual information includes "WEATHER" which is the keyword, the portion following a predetermined position which exists before "WEATHER" is automatically sounded. Consequently, the user can surely listen desired textual information in the form of synthesized speech, without conducting a cumbersome operation of always paying attention to the display screen.

Figure 8:
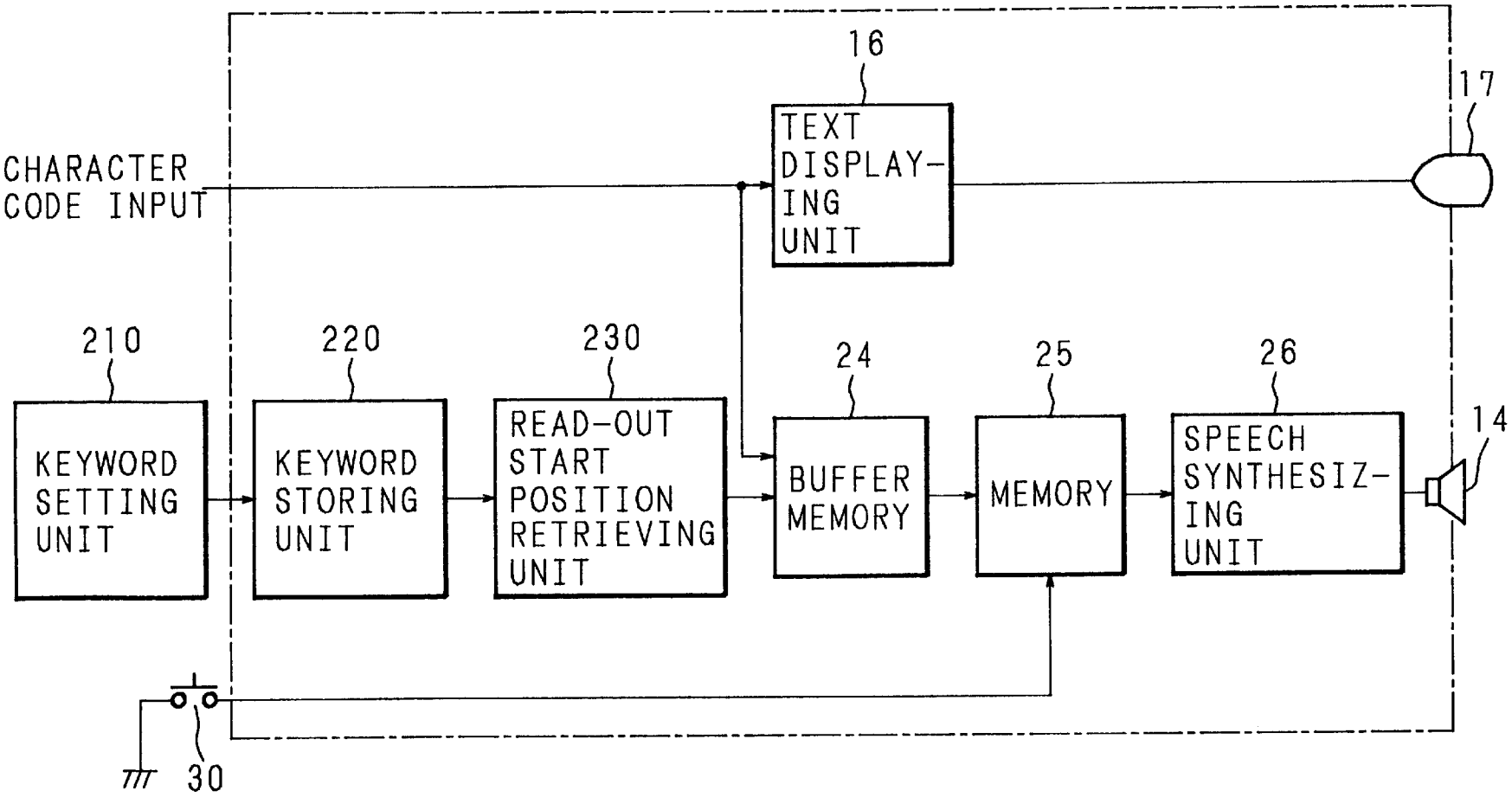
FIG. 8 is a block diagram showing a configuration example of a fourth embodiment of the apparatus for reading out textual information with synthesized speech according to the invention.

Next, a fourth embodiment of the apparatus for reading out textual information with synthesized speech according to the invention will be described. FIG. 8 is a block diagram showing a configuration example thereof.

The relationships between the fourth and third embodiments are the same as those between the second and first embodiments. In other words, in the third embodiment shown in FIG. 7, when a preset keyword is detected, the textual in formation desired by the user is immediately sounded in the form of synthesized speech. In the fourth embodiment, however, textual information desired by the user is sounded in the form of synthesized speech at the time desired by the user. Specifically, the fourth embodiment has a configuration in which a manual switch 30 identical with that of the second embodiment is added to the configuration of the third embodiment shown in FIG. 7.

The fourth embodiment is configured in the same manner as the third embodiment shown in FIG. 7 except that the manual switch 30 is added, and the difference in operation due to the configurational difference is identical with the difference between the second and first embodiments. Therefore, their description is omitted.

Figure 9:
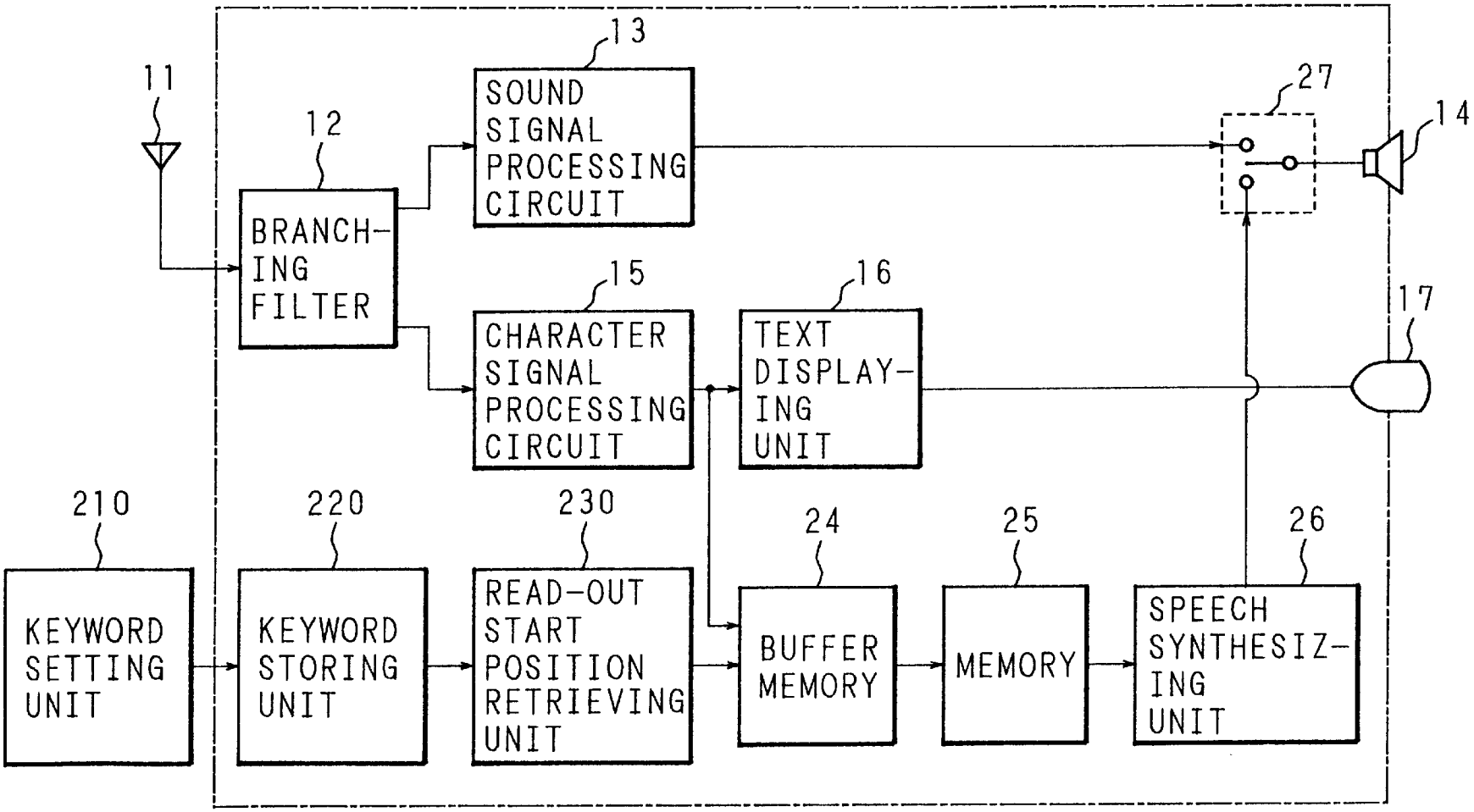
FIG. 9 is a block diagram showing a configuration example of a third embodiment of a teletext multiplex FM radio functioning as a teletext receiver to which the apparatus for reading out textual information with synthesized speech according to the invention is applied.
Figure 10:
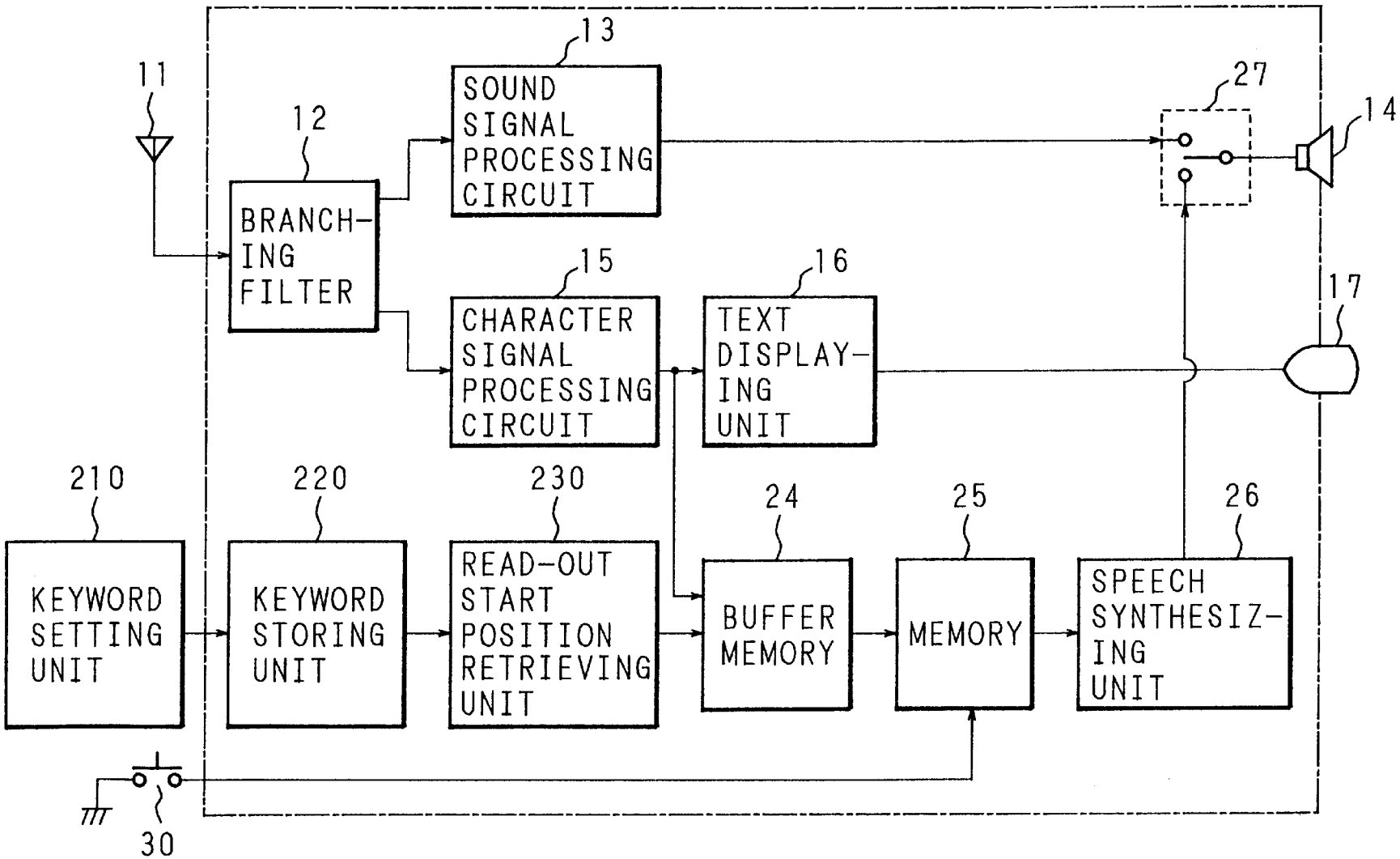
FIG. 10 is a block diagram showing a configuration example of a fourth embodiment of a teletext multiplex FM radio functioning as a teletext receiver to which the apparatus for reading out textual information with synthesized speech according to the invention is applied.

In the same manner as the above-described cases where the first and second embodiments of the apparatus for reading out textual information with synthesized speech according to the invention are applied to a teletext multiplex FM radio functioning as a teletext receiver, it is a matter of course that the third and fourth embodiments of the apparatus for reading out textual information with synthesized speech according to the invention can be applied to a teletext multiplex FM radio functioning as a teletext receiver. FIG. 9 is a block diagram showing the configuration example of a third embodiment of a teletext multiplex FM radio which is a teletext receiver to which the third embodiment of the apparatus for reading out textual information with synthesized speech according to the invention shown in FIG. 7 is applied. FIG. 10 is a block diagram showing a configuration example of a fourth embodiment of a teletext multiplex FM radio which is a teletext receiver to which the fourth embodiment of the apparatus for reading out textual information with synthesized speech according to the invention shown in FIG. 8 is applied.

The third and fourth embodiments of the teletext multiplex FM radio which is a teletext receiver, and the configuration of which is shown in FIG. 9 and FIG. 10 operate in the following manner. An FM radio wave received by the antenna 11 is branched by the branching filter 12 into a frequency band of sound information and that of textual information. The signal of branched sound signal frequency band is supplied to the usual sound signal processing circuit 13 which is similar to those used conventionally, so that a usual speech output of FM broadcasting is done. On the other hand, the signal of textual information frequency band which has been branched by the branching filter 12 is supplied to the character signal processing circuit 15 to be converted into a digital signal, and then sequentially supplied as character codes to the text displaying unit 16. The following operations are the same as those of the third and fourth embodiments of the apparatus for reading out textual information with synthesized speech according to the invention.

As described above in detail, according to the apparatus for reading out textual information with synthesized speech and the teletext receiver according to the invention, the user can listen to only desired textual information in the form of synthesized speech. Therefore, the user is not required to always watch a character code string displayed on the screen, and hence the user can listen to desired information while, for example, safely driving an automobile.

According to the apparatus for reading out textual in formation with synthesized speech and the teletext receiver according to the invention, textual information required by the user can be temporarily stored, and it can be sounded with synthesized speech at any time desired by the user. Consequently, the user can obtain required information even when the user has left the apparatus.

Further, according to the apparatus for reading out textual information with synthesized speech and the teletext receiver according to the invention, the user can preset a keyword and a required read-out region corresponding to the keyword by himself at need. Also, the user preset only a keyword for easy to use in practical use.

Also, in a service Such as a so-called electronic newspaper wherein a large amount of textual information is transmitted, furthermore, the user can easily select information.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An apparatus for reading out textual information with synthesized speech in which character codes of textual information inputted from the outside are displayed on a display device and read out with synthesized speech, said apparatus comprising:

a buffer memory for buffering character codes of textual information;

a keyword/read-out region storing unit which stores previously specified keyword and region of the textual information, said region being to be read out and including the keyword;

a read-out region retrieving unit, operably coupled to the keyword/read-out region storing unit, which retrieves the keyword stored in said keyword/read-out region storing unit from the character codes buffered in said buffer memory, and which, when the keyword exists, causes character codes corresponding to the read-out region stored in said keyword/read-out region storing unit, to be outputted from said buffer memory, wherein said read-out region retrieving unit checks on whether the keyword has been specified in character codes which have been buffered in the buffer memory in real time;

a speech synthesizing unit, operably coupled to the buffer memory, which converts the character codes outputted from said buffer memory, into a synthesized speech signal; and means, operably coupled to the speech synthesizing unit, for outputting the synthesized speech signal converted by said speech synthesizing unit, in the form of synthesized speech, wherein the keyword is found by a detection from a heading edge of text data.

2. A teletext receiver which comprises a character signal processing circuit for processing a received radio wave to generate character codes, and a display unit for displaying the character codes generated by said character signal processing circuit, in the form of characters, said apparatus further comprising:

a buffer memory for buffering the character codes generated by said character signal processing circuit;

a keyword/read-out region storing unit which stores previously specified keyword and region of the textual information, the region being to be read out and including the keyword;

a read-out region retrieving unit, operably coupled to the keyword/read-out region storing unit, which retrieves the keyword stored in said keyword/read-out region storing unit from the character codes buffered in said buffer memory, and which, when the keyword exists, causes character codes corresponding to the read-out region stored in said keyword/read-out region storing unit, to be outputted from said buffer memory, wherein said read-out region retrieving unit checks on whether the keyword has been specified in character codes which have been buffered in the buffer memory in real time;

a speech synthesizing unit, operably coupled to the buffer memory, which converts the character codes outputted from said buffer memory, into a synthesized speech signal; and means, operably coupled to the speech synthesizing unit, for outputting the synthesized speech signal converted by said speech synthesizing unit, in the form of synthesized speech, wherein the keyword is found by a detection from a heading edge of text data.

3. An apparatus for reading out textual information with synthesized speech in which character codes of textual information inputted from the outside are displayed on a display device and read out with synthesized speech, said apparatus comprising:

a buffer memory for buffering character codes of textual information;

a keyword/read-out region storing unit which stores previously specified keyword and region of the textual information, said region being to be read out and including the keyword;

a read-out region retrieving unit, operably coupled to the keyword/read-out region storing unit, which retrieves the keyword stored in said keyword/read-out region storing unit from the character codes buffered in said buffer memory, and which, when the keyword exists, causes character codes corresponding to the read-out region stored in said keyword/read-out region storing unit, to be outputted from said buffer memory, wherein said read-out region retrieving unit checks on whether the keyword has been specified in character codes which have been buffered in the buffer memory in real time;

a memory, operably coupled to the buffer memory, for temporarily storing the character codes outputted from said buffer memory;

a switch which causes character codes stored in said memory to be outputted;

a speech synthesizing unit, operably coupled to the buffer memory, which, when said switch is operated, converts the character codes outputted from said memory, into a synthesized speech signal; and means, operably coupled to the speech synthesizing unit, for outputting the synthesized speech signal converted by said speech synthesizing unit, in the form of synthesized speech, wherein the keyword is found by a detection from a heading edge of text data.

4. A teletext receiver which comprises a character signal processing circuit for processing a received radio wave to generate character codes, and a display unit for displaying the character codes generated by said character signal processing circuit, in the form of characters, said apparatus further comprising:

a buffer memory for buffering the character codes generated by said character signal processing circuit;

a keyword/read-out region storing unit which stores previously specified keyword and region of the textual information, the region being to be read out and including the keyword;

a read-out region retrieving unit, operably coupled to the keyword/read-out region storing unit, which retrieves the keyword stored in said keyword/read-out region storing unit from the character codes buffered in said buffer memory, and which, when the keyword exists, causes character codes corresponding to the read-out region stored in said keyword/read-out region storing unit, to be outputted from said buffer memory, wherein said read-out region retrieving unit checks on whether the keyword has been specified in character codes which have been buffered in the buffer memory in real time;

a memory, operably coupled to the buffer memory, for temporarily storing the character codes outputted from said buffer memory;

a switch which causes character codes stored in said memory to be outputted;

a speech synthesizing unit, operably coupled to the memory, which, when said switch is operated, converts the character codes outputted from said memory into a synthesized speech signal; and means, operably coupled to the speech synthesizing unit, for outputting the synthesized speech signal converted by said speech synthesizing unit, in the form of synthesized speech, wherein the keyword is found by a detection from a heading edge of text data.

5. An apparatus for reading out textual information with synthesized speech in which character codes of textual information inputted from the outside are displayed on a display device and read out with synthesized speech, said apparatus comprising:

a buffer for buffering character codes of textual information;

a keyword storing unit which stores previously specified keyword;

a read-out start position retrieving unit, operably coupled to the keyword storing unit, which retrieves the keyword stored in said keyword storing unit from the character codes buffered in said buffer memory, and which, when the keyword exists, causes character codes following a predetermined position before said keyword, to be outputted from said buffer memory, wherein said read-out start position retrieving unit checks on whether the keyword has been specified in character codes which have been buffered in the buffer in real time;

a speech synthesizing unit, operably coupled to the buffer memory, which converts the character codes outputted from said buffer memory, into a synthesized speech signal; and means, operably coupled to the speech synthesizing unit, for outputting the synthesized speech signal converted by said speech synthesizing unit, in the form of synthesized speech, wherein the keyword is found by a detection from a heading edge of text data.

6. A teletext receiver which comprises a character signal processing circuit for processing a retrieved radio wave to generate character codes, and a display unit for displaying the character codes generated by said character signal processing circuit, in the form of characters, said apparatus further comprising:

a buffer memory for buffering the character codes generated by said character signal processing circuit;

a keyword storing unit which stores previously specified keyword;

a read-out start position retrieving unit, operably coupled to the keyword storing unit, which retrieves the keyword stored in said keyword storing unit from the character codes buffered in said buffer memory, and which, when the keyword exists, causes character codes following a predetermined position before said keyword, to be outputted from said buffer memory, wherein said read-out start position retrieving unit checks on whether the keyword has been specified in character codes which have been buffered in the buffer memory in real time;

a speech synthesizing unit, operably coupled to the buffer memory, which converts the character codes outputted from said buffer memory, into a synthesized speech signal; and means, operably coupled to the speech synthesizing unit, for outputting the synthesized speech signal converted by said speech synthesizing unit, in the form of synthesized speech, wherein the keyword is found by a detection from a heading of text data.

7. An apparatus for reading out textual information with synthesized speech in which character codes of textual information inputted from the outside are displayed on a display device and read out with synthesized speech, said apparatus comprising:

a buffer memory for buffering character codes of textual information;

a keyword storing unit which stores previously specified keyword;

a read-out start position retrieving unit, operably coupled to the keyword storing unit, which retrieves the keyword stored in said keyword storing unit from the character codes buffered in said buffer memory, and which, when the keyword exists, causes character codes following a predetermined position before said keyword, to be outputted from said buffer memory, wherein said read-out start position retrieving unit checks on whether the keyword has been specified in character codes which have been buffered in the buffer memory in real time;

a memory, operably coupled to the buffer memory, for temporarily storing the character codes outputted from said buffer memory;

a switch, operably coupled to the memory, which causes character codes stored in said memory to be outputted;

a speech synthesizing unit, operably coupled to the switch, which, when said switch is operated, converts the character codes outputted from said memory, into a synthesized speech signal; and means, operably coupled to the speech synthesizing unit, for outputting the synthesized speech signal converted by said speech synthesizing unit, in the form of synthesized speech, wherein the keyword is found by a detection from a heading edge of text data.

8. A teletext receiver which comprises a character signal processing circuit for processing a received radio wave to generate character codes, and a display unit for displaying the character codes generated by said character signal processing circuit, in the form of characters, said apparatus further comprising:

a buffer memory for buffering the character codes generated by said character signal processing circuit;

a keyword storing unit which stores previously specified keyword;

a read-out start position retrieving unit which retrieves the keyword stored in said keyword storing unit from the character codes buffered in said buffer memory, and which, when the keyword exists, causes character codes following a predetermined position before said keyword, to be outputted from said buffer memory, wherein said read-out start position retrieving unit checks on whether the keyword has been specified in character codes which have been buffered in the buffer memory in real time;

a memory, operably coupled to the buffer memory, for temporarily storing the character codes outputted from said buffer memory;

a switch, operably coupled to the memory, which causes character codes stored in said memory to be outputted;

a speech synthesizing unit, operably coupled to the switch, which, when said switch is operated, converts the character codes outputted from said memory, into a synthesized speech signal; and means, operably coupled to the speech synthesizing unit, for outputting the synthesized speech signal converted by said speech synthesizing unit, in the form of synthesized speech, wherein the keyword is found by a detection from a heading edge of text data.

* * * * *